United States Patent [19]

Walker

[11] 4,159,242

[45] Jun. 26, 1979

[54] COAL WASHING APPARATUS

[76] Inventor: Leon Walker, P.O. Box 415, Welch, Okla. 74369

[21] Appl. No.: 822,802

[22] Filed: Aug. 8, 1977

[51] Int. Cl.[2] ..... B03B 7/00

[52] U.S. Cl. ..... 209/44; 209/17; 209/270; 209/291; 209/452

[58] Field of Search ..... 209/13, 17, 44, 155, 209/157, 270, 284, 285, 291, 293, 294, 473, 480, 481, 482, 450–452

[56] References Cited

U.S. PATENT DOCUMENTS

| | | | |
|---|---|---|---|
| 2,323,154 | 6/1943 | Ransohoff | 209/284 |
| 3,462,018 | 8/1969 | Hastrup | 209/284 |
| 3,815,737 | 6/1974 | Katter | 209/44 |

FOREIGN PATENT DOCUMENTS

| | | | |
|---|---|---|---|
| 95198 | 6/1922 | Switzerland | 209/451 |

*Primary Examiner*—Frank W. Lutter
*Assistant Examiner*—Jon E. Hokanson
*Attorney, Agent, or Firm*—James H. Chafin

[57] ABSTRACT

An apparatus for separating coarse and fine particles of intermediate specific gravity from an aggregate containing said particles of intermediate specific gravity as well as fine and coarse particles of higher specific gravity by use of a liquid of lesser specific gravity than any of said particles, which apparatus includes a pair of inclined, axially rotating, concentrically disposed helical ribbon flights separately secured within an annular housing such that the rotating action of said flights transports the fine and coarse particles of heavier specific gravity out of the flowing aggregate slurry. The fluid is then drained from the intermediate specific gravity particles passing with the fluid through the lower end of the annular housing in a screened cylinder.

1 Claim, 4 Drawing Figures

COAL WASHING APPARATUS

BACKGROUND OF THE INVENTION

There are many industrial uses for the machine classification of solids but the preponderant use thereof normally lies in the treatment of raw materials, such as mineral ores or other similar substances. Wet classification is defined as the art of separating the solid particles in a mixture of solids and liquid into fractions according to particle size or density by methods other than screening. Generally wet classifiers operate upon the difference in settling rate between coarse and fine or heavy and light gravity particles in the liquid medium so the coarse particles have a relatively faster settling velocity than fine particles of the same specific gravity and as heavy gravity particles have a relatively faster settling rate than light gravity particles of identical size. The rate of settling in some wet classifiers is also controlled by some extent by agitating the liquid medium, thus providing hindered settling.

In addition to use in separating the metallic ores, wet classification methods have also been applied in the preparation of coal. Coal preparation has become of greater importance in recent years as a result of an increase in mechanization in mining operations, which together with the growth of strip mining and depletion of the better quality coal seams in many coal fields has meant that run of mine coal contains increasingly larger quantities of foreign substances. These foreign substances tend in most cases to significantly increase the sulfur content, which of course is undesirable from an air pollution standpoint, thereby reducing the value of the coal obtained or rendering same unmarketable.

Wet classifiers in the coal industry have assumed a myriad of forms, ususally dependent upon the size of coal involved. The most widely employed classification methods are, however, jig and trough washing. An example of a trough type washer is disclosed in in the U.S. Pat. No. 3,739,911, issued June 19, 1973. The poolless auger separator described therein uses an open ended inclined trough having an auger in the bottom thereof. Coal and water are introduced at an intermediate point along the trough. The turbulent or agitated water flowing down the trough is regulated so that the coal is transported down the trough but the foreign substances, such as rocks, shale, fine clay and ash, having a specific gravity higher than the coal, settle to the trough bottom and are transported to the upper end of the trough by the auger thus separating the materials. In actual operations the device described has been found adequate for the removal of coarse rocks but the finer particles largely pass unhindered through the trough with the coal.

It is therefore an object of this invention to provide a means of separation which will efficiently and economically remove the fine heavy particles as well as the coarser heavy particles from the intermediate specific gravity materials with a liquid having a specific gravity less than any of the solids.

SUMMARY OF THE INVENTION

The invention contemplates a novel solids separator which may have many general uses in the wet classification art but is particularly useful for the water washing of sized coal to remove rocks, shale or other foreign substances therefrom which have a higher specific gravity than coal.

The apparatus may best be described generally as a device for separating coarse and fine particles of intermediate specific gravity from an aggregate containing said particles as well as fine and coarse particles of a higher specific gravity by use of a liquid having a lesser specific gravity than said solids. The term "intermediate" as used herein is used with reference to the specific gravities of the total solid and liquid charge to the apparatus. In reference to the solids charge alone, the term "intermediate" correspondingly refers to the lighter component of said solid charge.

The apparatus includes a first axially rotating inclined cylindrical housing having an open upper end for the discharge of fine heavy particles therefrom and a closed lower end. A first helical ribbon flight concentrically secured within said housing is used to transport fine heavy particles from the lower end thereof to the upper end. A second cylindrical housing concentrically disposed within the first housing for receiving the aggregate charge and liquid has an open upper end and a partially restricted lower end extending through the first housing. A lower portion of said second housing confined within the first housing is constructed of wire mesh or the like for admitting the passage of fine heavy particles from the interior of the second housing to the annular space between said first and second housings. A second helical ribbon flight is secured to and extends along the inner periphery of the second housing for transporting coarse heavy particles to the upper end thereof. The intermediate specific gravity particles and the washing fluid pass from the lower end of the second housing into a rotating cylindrical screen secured to and in alignment with the lower end of the second housing. In the cylindrical screen the fluid is drained from the intermediate specific gravity particles and said particles pass from the lower open end thereof.

Provision is also made for secondary washing of the intermediate specific gravity particles within the screened cylinder if warranted by the operator.

DETAILED DESCRIPTION OF THE PREFERRED EMBODIMENT

By way of example and illustration the preferred embodiment described herein will be discussed in terms of a machine operating to separate rocks and other heavy foreign substances from a coal aggregate containing same. It is to be understood however that the invention disclosed may be advantageously employed for the separation of other solid substances having differing specific gravities and is not to be construed as being limited solely to coal preparation applications.

Figure 1:
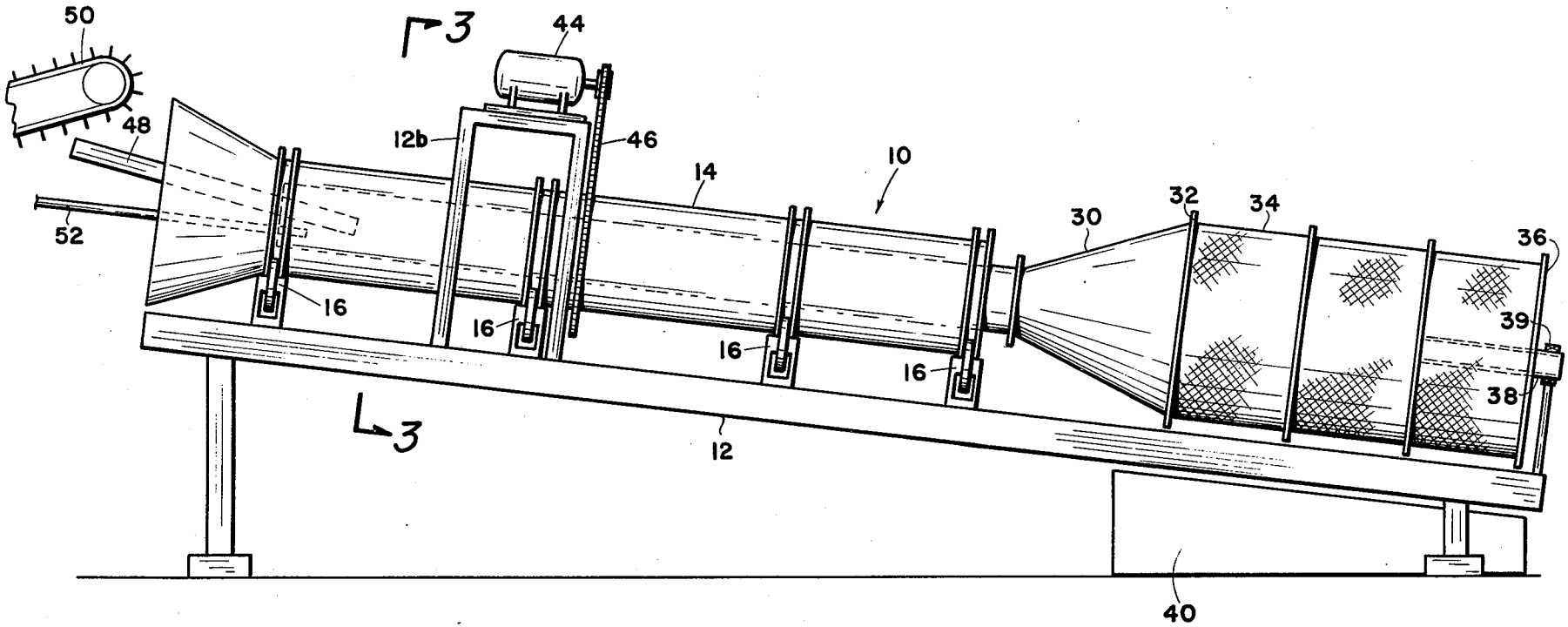
FIG. 1 is a side elevational view of an embodiment of the complete apparatus.

The separating apparatus is generally indicated by reference numeral 10 in FIG. 1 of the drawings. As shown therein, the apparatus is supported at an incline with the horizontal by a frame 12, preferably adjustable so that inclines of 4 to 12 degrees with the horizontal may be attained. The frame 12 may be a permanent type structure as shown or suitably equipped with an axle and wheel arrangement for mobile transportation to the operating site.

Figure 2:
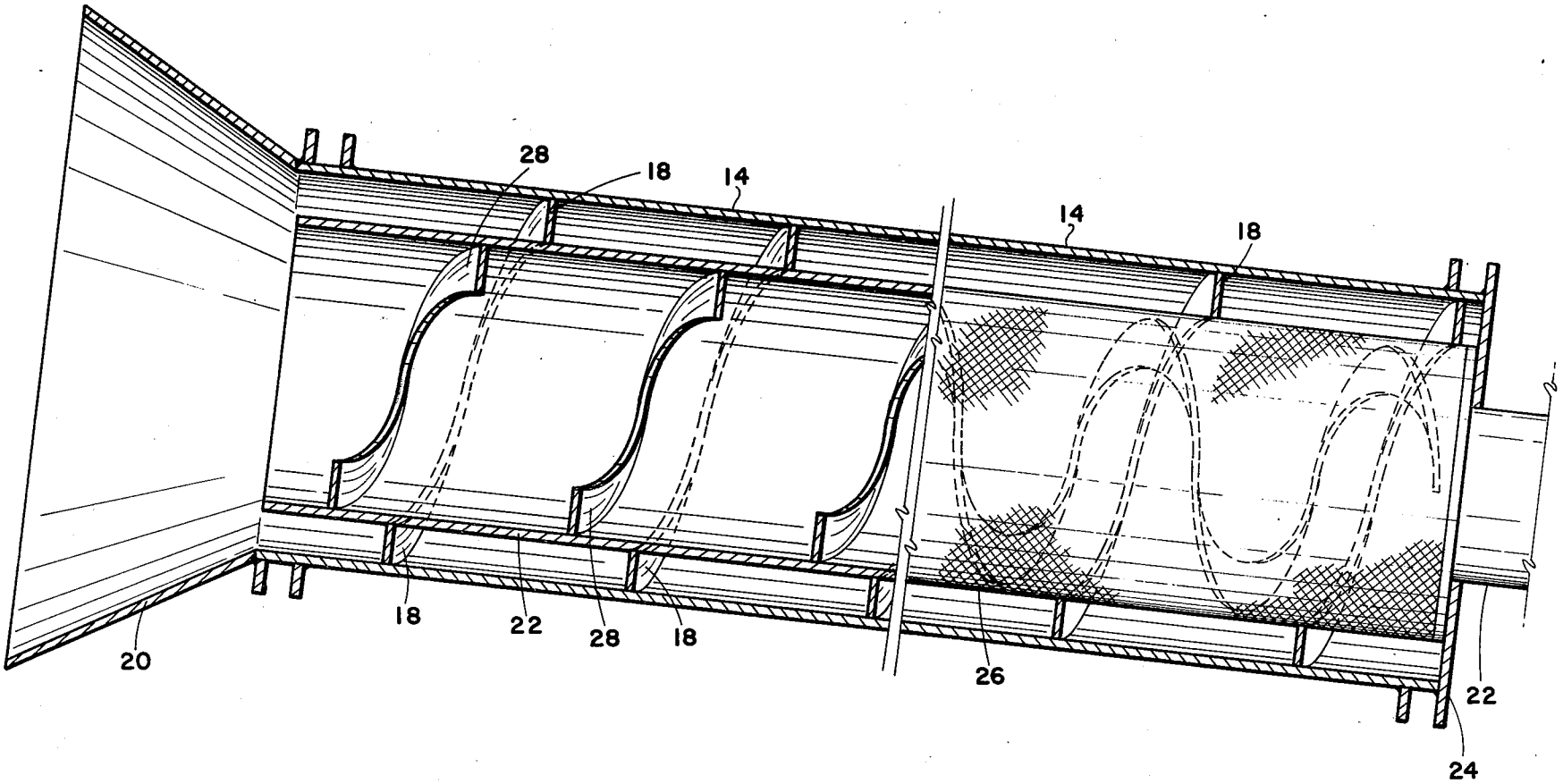
FIG. 2 is a view, partly in cross-section of the separator housings and ribbon flights.
Figure 4:
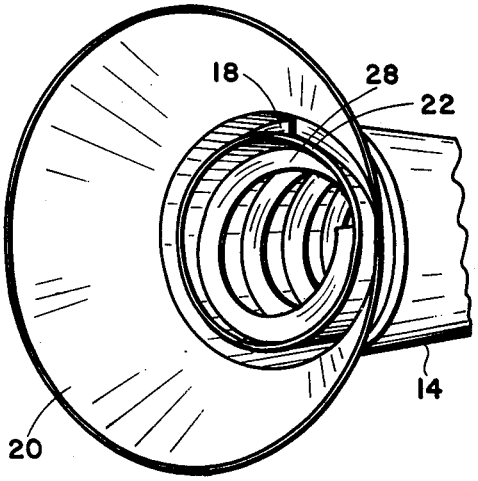
FIG. 4 is a perspective view of the rock discharge mouth.

Cylindrical housing 14 open at the upper end thereof is supported by a plurality of rollers 16 mounted to frame 12 so that the housing 14 is free to rotate about the center axis thereof. FIG. 2 of the drawings shows the housing 14 partly in cross-section. Situate within the housing is a first helical ribbon flight 18 extending the length of the housing and secured to the inner periphery of said housing 14. An open ended frustro conical rock discharge mouth 20 is welded or similarly secured to the upper end of housing 14. A perspective view of same appears in FIG. 4 of the drawings. A second cylindrical housing 22 is concentrically disposed within the first housing and extends from the upper end thereof through the lower end 24 of housing 14. The upper portion of housing 22 is solidly constructed whereas the lower portion thereof enclosed by housing 14 is either provided with a multiplicity of perforations or made from a stiff mesh as indicated in the figure. A suitable mesh for coal preparation is preferably sized to allow the passage therethrough of particles 0.060–0.080 inches in diameter. That portion of housing 22 which is sealingly secured to and protrudes through the end 24 of housing 22 is preferably reduced in diameter and is constructed of the same material as the upper solid portion of said housing 22 to withstand the torque imposed thereon.

Rigidly attached to the inner periphery of housing 22 and extending throughout the length of housing 14 is a second ribbon flight 28 complementarily spiraled with flight 18. The preferred diametric reduction of housing 22 mentioned in the preceding paragraph is such that the reduced inner diameter of said housing 22 corresponds to the inner diameter ribbon flight 28. The reduced diameter functions to hinder the passage of fines therethrough from the screened portion 26 of said housing. It is obvious that such purpose might be equally achieved through an annular retaining ring, if desired, within the spirit of the invention.

An open ended frustro conical coal discharge chute 30, as shown in FIG. 1, is secured in open communication and substantial axial alignment with the end of housing 22 extending through end 24 of housing 14.

Secured to end 32 of coal discharge chute 30 in substantial axial alignment and open communication therewith is a cylindrical screen housing 34 open at the lower end 36 thereof. The lower end of said screen housing is rotatably supported by means of a hollow tubular shaft 38, supported by radial struts (not shown) in the housing interior, suitably journalled in a thrust type bearing 39, said bearing 39 being supported by an extension of frame 12. The upper end of shaft 38 is provided with spray nozzles (not shown) or the like, and the lower end thereof is connected to a source of water for spraying the coal.

A trough 40 is preferably disposed under housing 34 for the collection of water passing through said screen.

Figure 3:
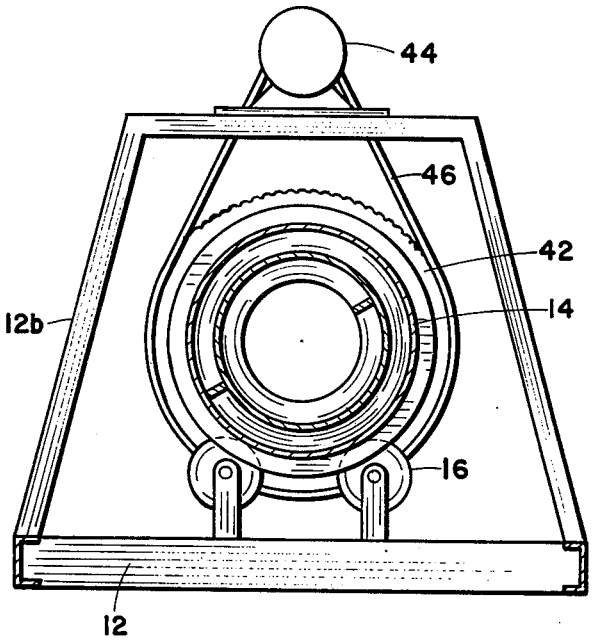
FIG. 3 is a view, partly in cross-section along line 3—3 of FIG. 1.

A circular drive gear 42, as shown in FIG. 3, is circumferentially mounted to the exterior of housing 14. Frame **12*b* attached to frame 12 provides support for overhead motor 44 which drives gear 42 by means of gear chain 46 for axially rotating housing 14 and 34**.

Coal charge chute 48, or other suitable means, extends in the interior of housing 22 to a point intermediate the upper end and the screened portion thereof. A conveyor 50 is used to feed sized unwashed coal to chute 48. Wash water is introduced to the interior of housing 22 by means of conduit 52 which terminates at a point therein such that the water is discharged at a point upstream from the discharge end of chute 48.

In operation, sized unwashed coal mixed within heavier fine and coarse rock is continuously fed into rotating housing 22 and a continuous stream of wash water added thereto by means of conduit 52. The relative flow rates are determined such that for the particular incline chosen the coal will be carried downstream but the coarse rocks, having a greater specific gravity than the coal, settle to the bottom of housing 22 and are conveyed to the upper end of said housing and discharged therefrom by the rotating action of ribbon flight 28. In the lower portion of housing 22, the fine rock passes through screen 26 and is conveyed to the upper end of housing 14 and discharged therefrom by the rotating action of ribbon flight 18. The coal and wash water are discharged through housing 22 into coal discharge chute 30 and rotating cylindrical screen 34. In screen 34 the water is drained from the coal into trough 40 and the washed coal discharged through the end 36 of housing 34. Additional wash water may be sprayed in the interior of housing 34 through tubular shaft 38 if required.

Excellent results have been obtained under field washing conditions with a 15′×31″ OD unit and 2×0 sized coal. With an incline of 7° and a housing rotation speed of 12–20 rpm, a water rate of approximately 1,000 gallons per ton of coal was found sufficient.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. An apparatus for separating particles of intermediate specific gravity from an aggregate containing said particles as well as fine and coarse particles of a higher specific gravity by use of a liquid of lesser specific gravity than any of said particles, which comprises:

a first axially rotatably inclined cylindrical housing having an open upper end and a closed lower end;

a first helical ribbon flight secured to the inner periphery of the first housing for transporting fine higher specific gravity particles to the upper end of the first housing;

a second cylindrical housing of substantially uniform cross-section throughout its length concentrically disposed within the first housing for receiving the aggregate therein, and being secured to said first housing within said first ribbon flight, said second housing having an open upper end and a centrally disposed open partially restricted lower end at the closed end of the first housing and extending through the central portion of the closed lower end of the first housing for discharging the intermediate specific gravity particles and liquid of lesser specific gravity, the lower portion of said second housing enclosed within the first housing having a plurality of perforation means in the sidewalls thereof for admitting the fine higher specific gravity particles therethrough;

a second helical ribbon flight secured to the inner periphery of the second housing and open in the center portion thereof for transporting coarse higher specific gravity particles to the upper end of the second housing;

means for introducing said liquid of lesser specific gravity into said second housing;

means for introducing said particles into said second housing; and means operably connected to the first housing for rotating said first housing.

* * * * *